United States Patent [19]

Cohen

[11] 3,937,469

[45] Feb. 10, 1976

[54] GAMES USING MAGNETICALLY ACTUATED MEMBERS

[76] Inventor: Samuel W. Cohen, 4001 Beach 44th St., Brooklyn, N.Y. 11224

[22] Filed: June 6, 1974

[21] Appl. No.: 476,773

[52] U.S. Cl. ..... 273/85 F

[51] Int. Cl.[2] ..... A63F 7/06

[58] Field of Search..... 273/85 R, 85 B, 85 D, 85 F, 273/94 D:94 F, 103

[56] References Cited

UNITED STATES PATENTS

| | | | |
|---|---|---|---|
| 1,819,932 | 8/1931 | Walden | 273/85 R |
| 3,214,171 | 10/1965 | Luchsinger | 273/85 F |
| 3,827,692 | 8/1974 | Morrison et al. | 273/85 F |

FOREIGN PATENTS OR APPLICATIONS

| | | | |
|---|---|---|---|
| 625,448 | 9/1961 | Italy | 273/85 R |
| 699,567 | 11/1953 | United Kingdom | 273/85 D |
| 1,069,908 | 2/1954 | France | 273/85 D |
| 392,351 | 9/1965 | Switzerland | 273/85 F |

*Primary Examiner*—Paul E. Shapiro
*Assistant Examiner*—Harry G. Strappello
*Attorney, Agent, or Firm*—Darby & Darby

[57] ABSTRACT

A basketball game using magnetically attracted members which are moved by a magnetic actuator disposed on one or both surfaces of the gameboard under the control of one or more players in which the members are moved. The members are moved to hit a resilient ball against a projection, which also may be resilient, so that the ball can be lofted toward a raised basket. Access to certain areas in front of the basket is restricted by an arcuate guard on one of the top or bottom surfaces.

6 Claims, 7 Drawing Figures

GAMES USING MAGNETICALLY ACTUATED MEMBERS

This invention relates to amusement games and games of skill and more particularly to games which are played by one or more players in a competitive fashion. In accordance with the invention, a variety of games are disclosed in which the player or players moves an actuator disposed on the upper and/or lower surface of the gameboard. The gameboard has therein one or more members or objects which are to be moved. The actuator and the member each have a piece of material which is mutually magnetically attractive so that when an actuator is disposed adjacent a member the two pieces of material will attract each other and the member will be moved as the player moves the actuator.

In accordance with the invention, various types of games are disclosed including a boxing game with a simulated ring, a fencing game, a football game, a racing game and a basket-ball game. In the case of the basketball game, a simulated basketball court is provided having baskets at each end. One player manipulates his team member to hit a ball to make it, in turn, hit a projection to cause the ball to jump into the air towards the basket. The opposing player moves his men to try to block shots and perform other defensive maneuvers.

It is therefore an object of the present invention to provide various types of games having one or more members located within a gameboard which are moved by the control of an actuator disposed on the gameboard, the member and the actuator each having mutually magnetically attractive material thereon.

A further object is to provide a variety of games having members which are moved by a player manipulating an actuator, including boxing, basketball and football and racing.

Yet a further object is to provide a basketball game having team members which are moved by a player controlling an actuator to cause a ball to hit a projection to make the ball rise in the air toward a basket.

Other objects and advantages of the present invention will become more apparent upon reference to the following specification and annexed drawings, in which.

Figure 1:
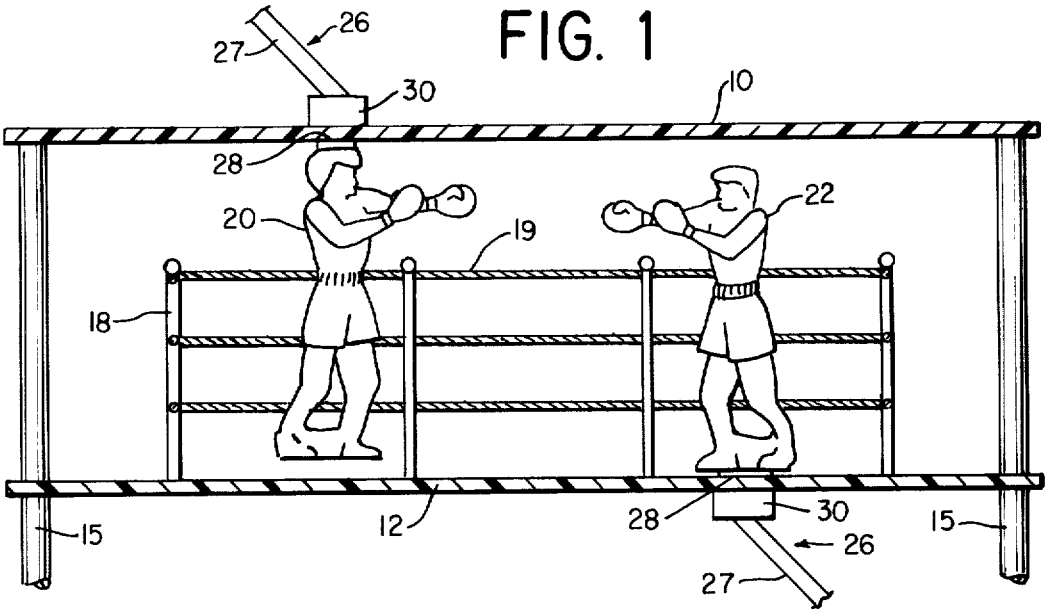
FIG. 1 is a cross-sectional view of one embodiment of my invention showing a boxing game.

Referring to FIG. 1, the first of my games utilized to simulate a boxing match includes upper and lower flat plate members 10 and 12 which are supported in spaced relationship by vertical pieces 15 serving as legs for the gameboard. One or more of the sides between the plates are preferably left open. At the least the top plate 10 is of transparent material, such as glass or plastic, whose upper surface is smooth. The outer surface of lower plate 12 is also smooth and plate 12 can also be made of transparent material, although this is not absolutely necessary. Plates 10 and 12 are of a non-magnetic material. The gameboard is supported on lower plate 12 by legs 15 mounted adjacent the edge of the bottom plate. The central area of the bottom of the gameboard is left clear.

Located within the interior of the gameboard is a simulated boxing ring formed by the plurality of upstanding posts 18. The posts 18 extend only part way between the upper and lower plates 10 and 12 and other members used to support the two plates. The posts 18 are arranged to provide a square boxing area in the shape of a boxing ring. Tied to, or suspended from the posts 18 are a plurality of "ropes" 19 corresponding to the ropes employed in the boxing ring. It is preferred that an elastic material, such as rubber or plastic, be utilized for the ropes 19 to give additional action to the game.

Located within the boxing ring area are a pair of boxers 20 and 22 which are made of plastic, rubber, or any other suitable material to have the general shape of humans. The boxers 20 and 22 are shown in the classic boxing pose with extended arms. The height of each of the boxers is less than the spacing between the two plates so that each boxer can fall over and, also, to reduce sliding friction.

An actuator 26 is shown disposed, one on the upper plate 10 and the other on the lower plate 12. Each of the actuators includes an elongated stick 27 to be held and manipulated by a player of the game. If desired, the actuators can be simple, peg-like members. Boxer 20 has mounted on top of its head a piece of material 28 which is mutually attracted by lines of magnetic force to another piece of material 30 mounted on the end of the actuator. For example, the piece 28 can be of magnetic material, that is a permanent magnet, and piece 30 of ferromagnetic steel, or a magnet of opposite polarity to that of the actuator. A piece 28 is located adjacent the feet of boxer 22. As should be apparent, the two members 28 and 30 are mutually magnetically attracted so that when an actuator 26 is moved by the player the boxer will move along with it. Since one player uses the top surface and the other the bottom, the moves of each are obscured from each other and they will not interfere.

The game is played by having two players, or one player, manipulate the two actuators 26 and thereby move the boxers. These are moved in such a way so that the boxers fight with each other and/or perform defensive manuevers. A boxer can be turned by turning its actuator to hit with either the right or the left hand or to duck the puchhes of the other boxer. The movement of the boxer is limited by the ropes 19 thereby effectively simulating an actual boxing match. A knockdown occurs when one player manipulates his boxer to hit the other in such a way as to separate the two magnetic pieces 28, 30 and cause the first mentioned boxer to fall over. The player whose boxer was knocked down can reach through the ropes and stand him upright again.

An arrangement similar to that of FIG. 1 can be used for fencing. Here, the ropes 19 can be dispensed with. The boxers would now be in the shape of fencers and carry a pointed member corresponding to a sword. A "touch" would occur when one fencer's sword engaged the other fencer or knocked him down. The player whose fencer was knocked down can reach in through an open side to stand him up again.

Figure 2:
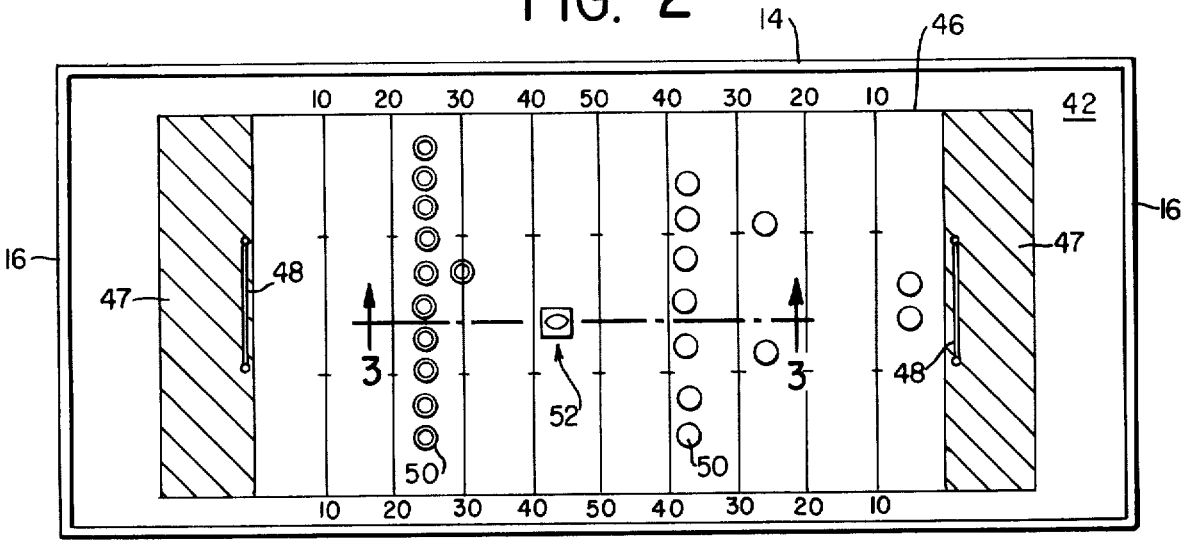
FIG. 2 is a top view of another embodiment of the invention used for playing football.
Figure 3:
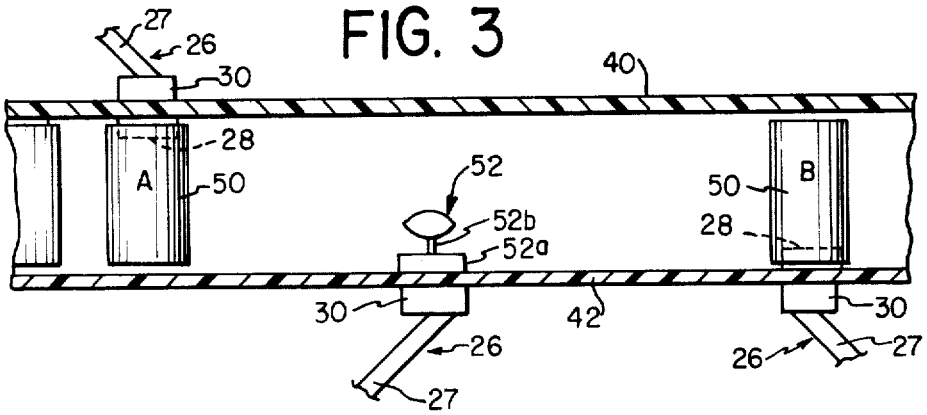
FIG. 3 is a cross-sectional view of the embodiment of FIG. 2 taken along lines 3—3 of FIG. 2.

FIGS. 2 and 3 show another embodiment of the invention utilized for playing football. Here, the gameboard includes upper and lower plates 40 and 42, at least the upper plate of which is transparent. These plates are also suspended around the periphery by side members 14 and end members 16.

The lower plate 42, which also can be transparent has painted or stenciled thereon the various yard markings and sidelines 46 and the end zone areas 47 corresponding to a football field. Goal posts 48 are located in the end zone areas and are fastened either to the top plate 40, the bottom plate 42 or suspended between both plates. The gameboard also has mounting legs (not shown) at its edges to leave a clear central area beneath the playing zone.

A plurality of tem members 50, hereafter called teams A and B, are located in the space between the two plates 40 and 42. Each of the members 50 is of generally circular shape and can have, for example, the face of a football player painted thereon or uniforms painted thereon. If desired, the upper portion of each member 50 can be shaped to have features of a football team member. The members 50 can be of any suitable material, for example, plastic or wood.

As in the case of the embodiment of FIG. 1, actuators 26 are provided for each of the upper and lower plates. In this case, there are a pair of actuators for each of the upper and lower plates. Each of the members 50 of team A has a mutually magnetically attractive piece 28 at its upper end and each of the players 50 of team B has a similar piece 28 at its lower end.

A "football" 52 of non-magnetic material is provided. The football has a base or pedestal **52*a* and the ball itself is attached to a stem 52*b*. Pedestal 52*a*** has a flat bottom so it can glide over the inner surface of the bottom plate.

The game players manipulate the actuators 26 to achieve action simulating a football game. As shown, for example, in FIG. 2, the members 50 of team A are aligned in kick-off formation and those of team B in kick-off return formation. The game starts by having a member of team A manipulate his actuator 26 to "kick" the football 52 by moving one of the A members 50 towards it and hitting it. The ball 52 is "received" by a B team member who will run it back toward team A's goal 48 by moving the actuator adjacent the B member to carry the ball along with it. The B member having the ball is tackled when he is hit by an A member as the actuator for the A member is manipulated and/or the football 52 is hit and toppled over by an A team member.

For ensuing plays, the members of the team are lined up in the appropriate offensive and defensive formations. A run is simulated by having a member carry the ball along with it as the member is moved. A pass is simulated by moving a member to hit the ball to have it travel a distance toward another offensive team member, a back or an end, who has previously been moved into position. This can be accomplished by having the game player on offense manipulating the two actuators. A pass is completed if the ball "thrown" by one member hits the other member of the same team. The defensive game player can manipulate his two actuators to have two of this team members attempt to stop the run, block the pass, tackle another member, etc. The B member having the ball is tackled when he is hit by an A member as the actuator for the A member is manipulated and/or the ball 52 is toppled over.

If the footballl game is played by toppling the ball over, then either one or more of the sides of the gameboard can be left open, so the ball can be righted, or the top plate can be hinged to one of the side supports.

Figure 4:
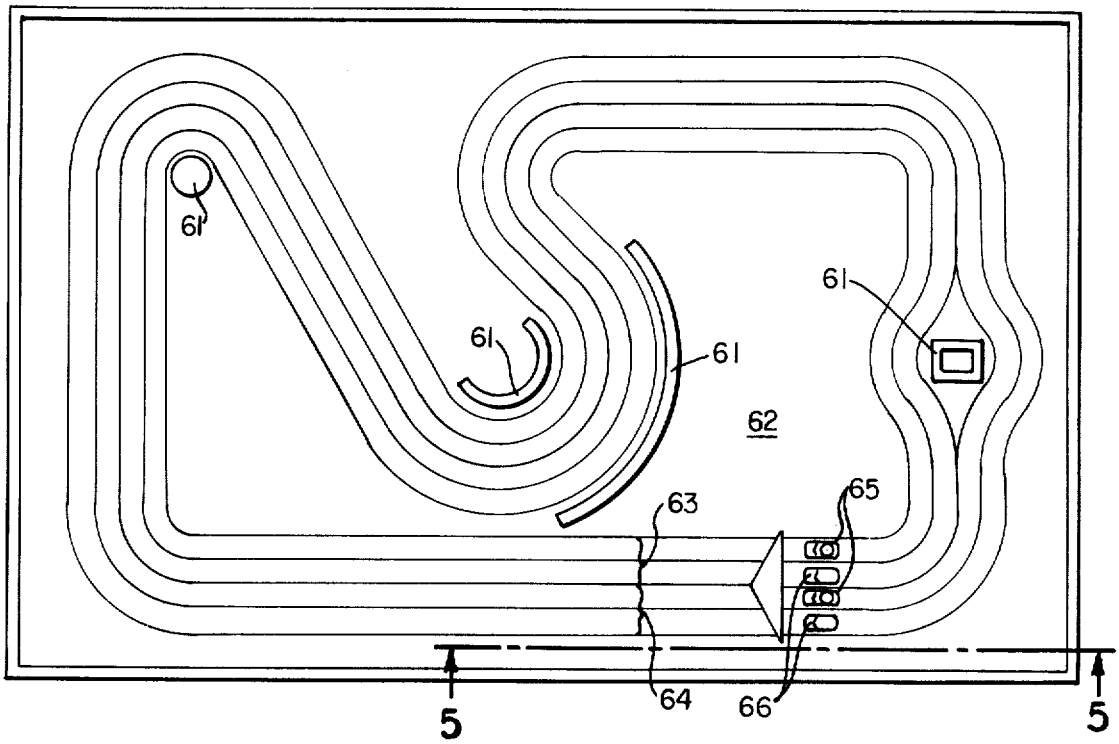
FIG. 4 is a top view of another embodiment of the invention for racing cars.
Figure 5:
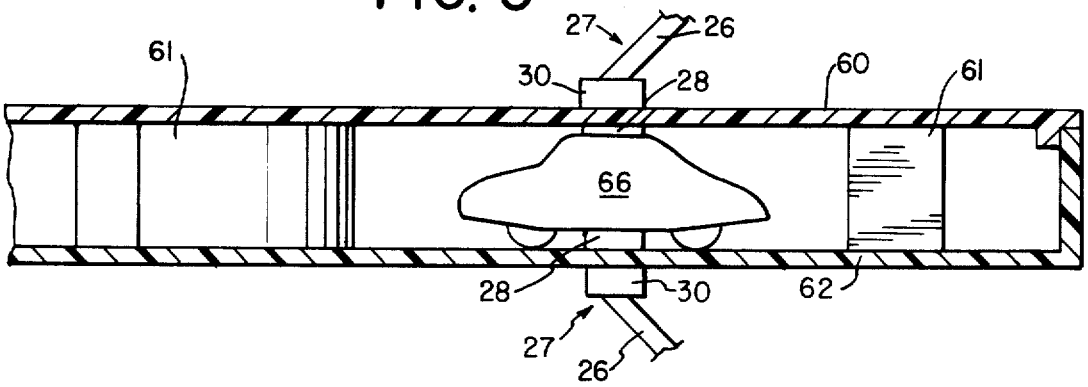
FIG. 5 is a cross-sectional view taken along lines 5—5 of FIG. 4.

FIGS. 4 and 5 show still a further embodiment of the invention which is used for racing pieces which can simulate cars, boats, dogs, horses, or humans. In this case, cars are illustratively shown and upper and lower plates 60 and 62 have located therebetween a plurality of obstacles of different shapes. A plurality of tracks, illustratively shown as four tracks in two pairs 63 and 64 are used. Each track is as wide as a respective car 65 or 66 painted or stencilled on the bottom plate 62.

Each player of the game has a pair of actuators. One player uses two actuators on the top plate and the other uses two on the bottom plate. Each of the cars 65 and 66 has a mutually magnetically attractive piece 28 on either the top or bottom thereof. Each player controls two cars by moving his trip actuators on one of the plates.

The players play the game by each trying to maneuver his cars in the respective pair of tracks 63 or 64 from start to finish. Each player can manipulate his car to try to bump the other car into an obstacle 61.

Figure 6:
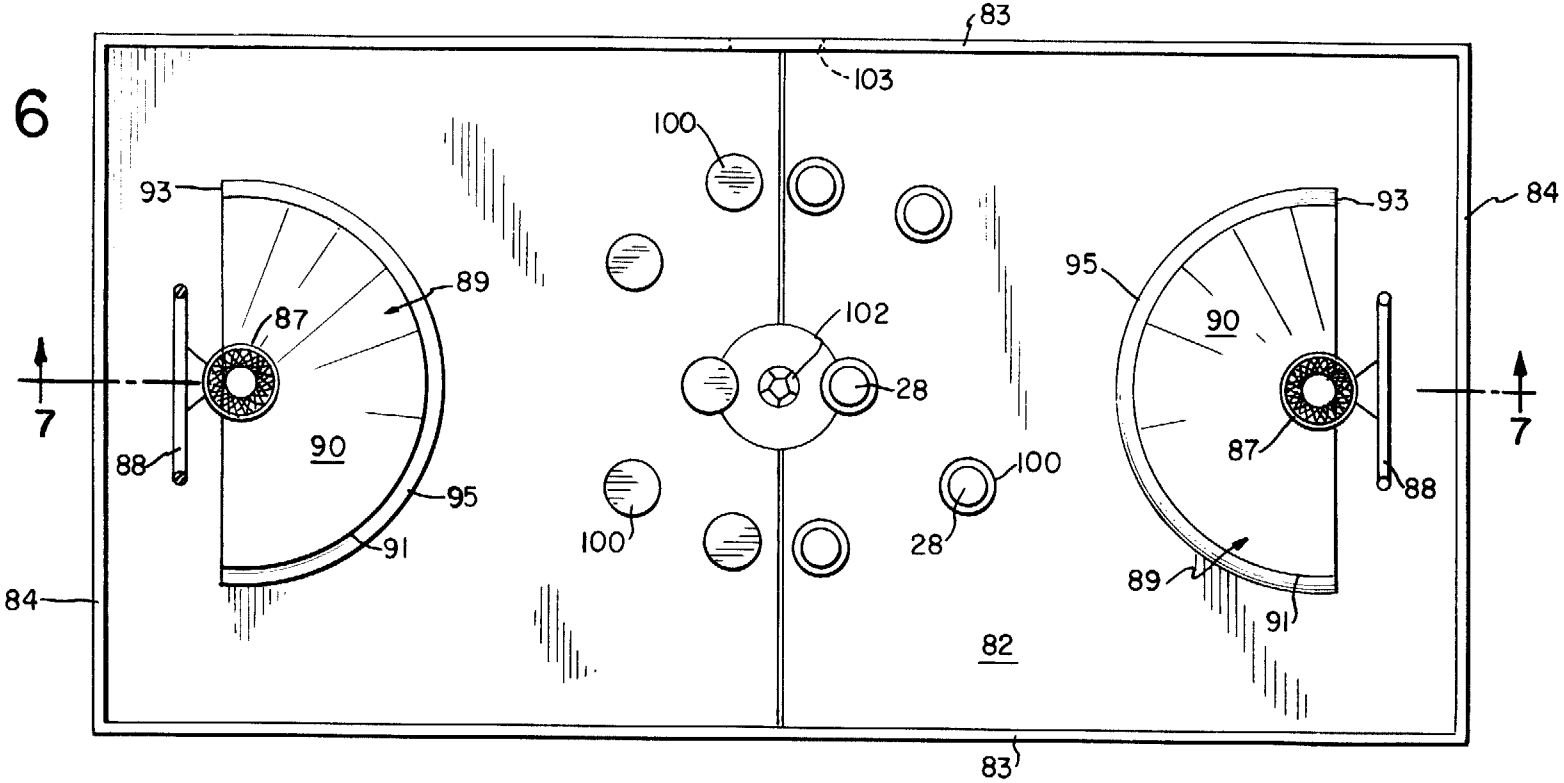
FIG. 6 is a top view of a further embodiment of the invention showing a basketball game.
Figure 7:
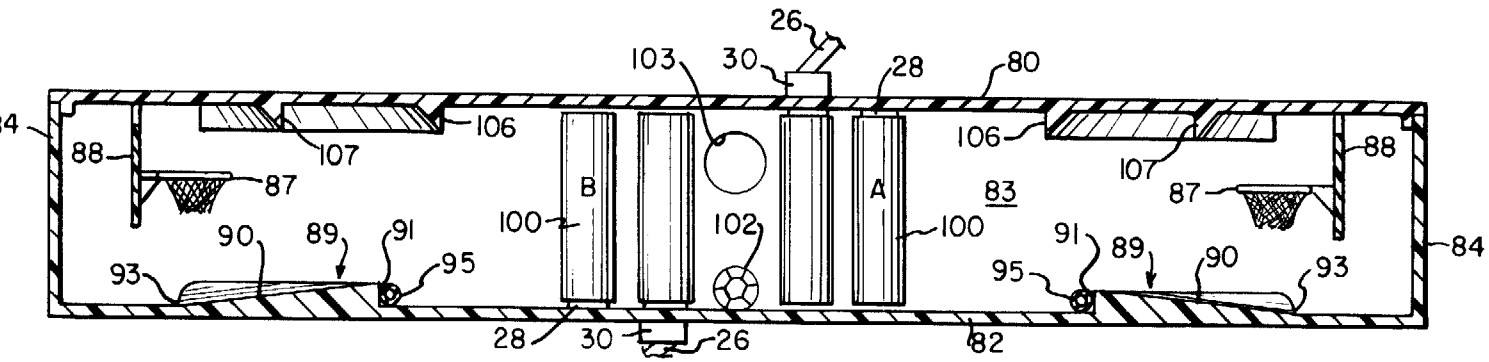
FIG. 7 is a cross-sectional view taken along lines 7—7 of FIG. 6.

FIGS. 6 and 7 show still a further embodiment of the invention which is used for playing basketball. Here, the upper and lower plates 80 and 82 are supported by side pieces 83 and end pieces 84. There are also legs for mounting the gameboard to leave the central area totally open. A basket 87 is mounted on a backboard 88 which is in turn attached to the upper plate. if desired, the backboards could be attached to the lower plate. The backboard is spaced out from the wall 84 by a width at least as great as one player. The lines and areas simulating a basketball court are painted or stencilled on the bottom plate.

Located in front of each of the baskets 87 and spaced therefrom on the lower plate 82 is a semi-circular raised obstruction 89 having a concave central section 90 which tapers inwardly from a raised front edge 91 to be flush with the surface of the bottom board. The ends 93 of each obstruction 89 is spaced from the respective end piece 84 by a distance at least as great as the maximum width of a team member 100. A resilient member 95, for example a tubular rubber bumber 95, is placed around the front edge 91 of each section 89. A ridge 106 can be formed on the inner surface of the upper plate. Ridge 106 can have the same shape as obstruction 90 but be spaced therefrom more towards the center of the court. A similar ridge 107 is formed closer into the basket, above the concave area 90. Both ridges are designed to contact the top of the team members so that they cannot move in front of the basket.

A basketball 102 is used which is inserted into the playing area through an opening 103 in the side wall which is preferably closed by a removable plate (not shown). The basketball is of rubber or other suitable material with a lot of bounce. The material used in the so-called SUPER-BALL can be used.

As before, the members 100 of two teams are provided and are of generally cylindrical shape. These can be distinguished by different colors. The players 100 are of generally cylindrical shape having a height slightly less than that of the space between the upper and lower plates 80 and 82. The members of team A each have a magnetically attractive piece 28 at the top thereof and those of the team B have a piece 28 at the bottom. As before, actuators 26 are used with the respective magnetically attractive pieces 30. The game can be played with each player having one or two actuators. In the latter case, both actuators of a player are used on the same plate.

The game proceeds with the one player manipulating his respective actuators 26 to move his team members to hit the ball 102 and cause it to go into the basket. The player on defense moves his team members to try to block this. The player on offense moves his team members to strike the ball 102 with sufficient speed so that it will hit the bumper 95 and bounce upwardly into the basket 87. The ball can bounce off of the backboard 88. If the basket is missed, causing a rebound, the ball will fall into section 89 and move down the concave area 90 into the space between the end wall 84 and the section's rear edge 93. A member of either team can be moved into this space to clear out the ball or to bring the ball back into play from "out of bounds" when a basket has been made. The ball can be passed from one team member to the other.

The player on defense attempts to manipulate his team members to block passes between the members of the other team, to block shots. The team members can be positioned by the players to attempt to obtain the best offensive and defensive advantage.

In some cases, where the ball 102 is sufficiently resilient, the bumper 95 can be dispensed with.

In the football game of FIGS. 2 and 3 and the basketball game of FIGS. 6 and 7, the team members are shown as being of generally cylindrical shape, at least in the lower area thereof which is to strike the ball. This is desirable since an impact area of each team member is presented to the ball at all angular orientations of the members. This speeds up the action of the game since the game players do not have to turn the actuators.

In the case of the various games using team members, that is, the football game of FIGS. 2–3 and the basketball game of FIGS. 6–7, it should be understood that the team members can be of any suitable shape, e.g. cylindrical, triangular, square or paraboloid. Any other suitable irregular shape also can be used. The principal requirement is that a team member present an impact force to the object being struck, the ball or football, at any angular orientation of the team member with respect to the object.

What is claimed is:

1. A basketball game comprising a game board formed of upper and lower plates, means for holding said plates in a spaced relationship to define a game area therebetween, means in said game area defining a simulated basketball court, said means including a basket at each end of said court which is raised from the surface of the bottom plate, a plurality of team members disposed within said game area, actuator means disposed and movable over the outer surface of one of said plates, mutually magnetic attractive means on said actuator means and on said team members so that said team members are moved and carried along as the actuator means is moved, a ball of resilient material, a projection extending upwardly from said bottom plate in front of each basket for engagement by the ball as it is moved by being hit by a moving team member under the control of said actuator means, and resilient means adjacent said upwardly extending projection to further assist in projecting the ball upwardly toward the basket when it hits the projection.

2. A basketball game as in claim 1 further comprising means on the inner surface of one of said plates to limit the freedom of travel of the team members in the area of the basket.

3. A basketball game as in claim 1 wherein said upwardly extending projection is of a generally semi-circular shape in front of each basket.

4. A basketball game as in claim 1 wherein said plurality of team members comprise a plurality of each first and second team members, said mutaully attractive magnetic means located adjacent the top of said first team members and the bottom of said second team members, and a respective actuator means disposed on the outer surface of each of said top and said bottom plates.

5. A basketball game comprising a game board formed of upper and lower plates, means for holding said plates in a spaced relationship to define a game area therebetween, means in said game area defining a simulated basketball court, said means including a basket at each end of said court which is raised from the surface of the bottom plate, a plurality of team members disposed within said game area, actuator means disposed and movable over the outer surface of one of said plates, mutually magnetic attractive means on said actuator means and on said team members so that said team members are moved and carried along as the actuator means is moved, a ball, a projection extending upwardly from said bottom plate in front of each basket for engagement by the ball as it is moved by being hit by a moving team member under the control of said actuator means, one of said ball and said projection including resilient material so that the ball is projected upwardly toward the basket when it hits the projection, each said upwardly extending projection being arcuate in shape and extending in front of and to each side of a respective basket and having at least one opening through which a team member can pass in towards the basket.

6. A basketball game as in claim 5 wherein said ball is of resilient material.

* * * * *